US011249427B2

(12) United States Patent
Honda

(10) Patent No.: US 11,249,427 B2
(45) Date of Patent: Feb. 15, 2022

(54) IMAGE FORMING APPARATUS HAVING IMAGE CANCELING FUNCTION

(71) Applicant: KYOCERA Document Solutions Inc., Osaka (JP)

(72) Inventor: Takahiro Honda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/157,111

(22) Filed: Jan. 25, 2021

(65) Prior Publication Data

US 2021/0240109 A1 Aug. 5, 2021

(30) Foreign Application Priority Data

Jan. 31, 2020 (JP) ..... JP2020-015076

(51) Int. Cl.
*G03G 15/00* (2006.01)
*G03G 15/01* (2006.01)
*G03G 15/16* (2006.01)

(52) U.S. Cl.
CPC ..... *G03G 15/5012* (2013.01); *G03G 15/0136* (2013.01); *G03G 15/55* (2013.01); *G03G 15/0131* (2013.01); *G03G 15/161* (2013.01); *G03G 2215/00548* (2013.01)

(58) Field of Classification Search
CPC ..... G03G 15/161; G03G 15/0136; G03G 15/5012; G03G 15/55; G03G 2215/00548; G03G 2215/00552; G03G 2215/00949; G03G 2215/00603; G03G 2215/0196
USPC ..... 399/85, 302
See application file for complete search history.

(56) References Cited

U.S. PATENT DOCUMENTS 6,738,594 B2 * 5/2004 Nakagawa ..... G03G 15/0194 399/299
9,645,528 B2 * 5/2017 Minato ..... G03G 15/161
2007/0110459 A1 * 5/2007 Oominami ..... G03G 15/01 399/38
2008/0226328 A1 * 9/2008 Sakabe ..... G03G 15/50 399/82
2017/0068196 A1 * 3/2017 Ujike ..... G03G 15/55
(Continued)

FOREIGN PATENT DOCUMENTS

JP 2000-259047 A 9/2000
JP 2014186077 A * 10/2014

*Primary Examiner* — Robert B Beatty
(74) *Attorney, Agent, or Firm* — Studebaker & Brackett PC

(57) ABSTRACT

An image forming apparatus includes an image forming part, a canceling processing part, a first switching processing part and a second switching processing part. The canceling processing part is performable an image canceling operation where a toner image formed on an intermediate transferring member is removed from the intermediate transferring member without transferred to a sheet. The first switching processing part is capable of switching a printing mode in the image forming part between a plurality of printing modes having different printing conditions in the image forming part, based on an image data under waiting for printing and a predetermined first switching condition. The second switching processing part is capable of switching the printing mode based on the image data under waiting for printing and a predetermined second switching condition when the image canceling operation is performed.

12 Claims, 4 Drawing Sheets

(56) References Cited

U.S. PATENT DOCUMENTS

2017/0364009 A1* 12/2017 Shimura ..... G03G 15/0136
2018/0039212 A1* 2/2018 Tomine ..... G03G 15/0189

* cited by examiner

IMAGE FORMING APPARATUS HAVING IMAGE CANCELING FUNCTION

INCORPORATION BY REFERENCE

This application is based on and claims the benefit of priority from Japanese patent application No. 2020-015076 filed on Jan. 31, 2020, which is incorporated by reference in its entirety.

BACKGROUND

The present disclosure relates to an image forming apparatus having a plurality of printing modes.

An image forming apparatus capable of printing a color image may have a monochrome printing mode capable of printing a monochrome image and a color printing mode capable of printing a color image as the printing mode. In the image forming apparatus of this type, the printing mode may be switched according to a type of color of an image data to be printed. For example, when the printing mode is switched, a mode switching processing may be performed to switch a scanning speed of laser light used to write an electrostatic latent image on a photosensitive drum. Alternatively, when the printing mode is switched, another mode switching processing may be performed to bring or separate an intermediate transferring belt, on which a toner image is formed, into contact with or from a photosensitive drum from which the toner image is transferred to the intermediate transferring belt.

However, because the mode switching processing to switch the printing mode requires a certain period of time, there is a problem that a productivity of the image forming apparatus is deteriorated when the printing mode is frequently switched.

SUMMARY

In accordance with an aspect of the present disclosure, an image forming apparatus includes an image forming part, a canceling processing part, a first switching processing part and a second switching processing part. The image forming part transfers a toner image formed on an intermediate transferring member from the intermediate transferring member to a sheet. The canceling processing part is performable an image canceling operation where the toner image formed on the intermediate transferring member is removed from the intermediate transferring member without transferred to the sheet. The first switching processing part is capable of switching a printing mode in the image forming part between a plurality of printing modes having different printing conditions in the image forming part, based on an image data under waiting for printing and a predetermined first switching condition. The second switching processing part is capable of switching the printing mode based on the image data under waiting for printing and a predetermined second switching condition when the image canceling operation is performed.

In accordance with an aspect of the present disclosure, an image forming method in an image forming apparatus including an image forming part which transfers a toner image formed on an intermediate transferring member from the intermediate transferring member to a sheet, includes a canceling step, a first switching step and a second switching step. The canceling step is performable an image canceling operation where the toner image formed on the intermediate transferring member is removed from the intermediate transferring member without transferred to the sheet. The first switching step is capable of switching a printing mode in the image forming part between a plurality of printing modes having different printing conditions in the image forming part, based on an image data under waiting for printing and a predetermined first switching condition. The second switching step is capable of switching the printing mode based on the image data under waiting for printing and a predetermined second switching condition when the image canceling operation is performed.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, one embodiment of the present disclosure will be described. The embodiment described below are embodied examples of the present disclosure, and are not intended to limit the technical scope of the present disclosure.

Figure 1:
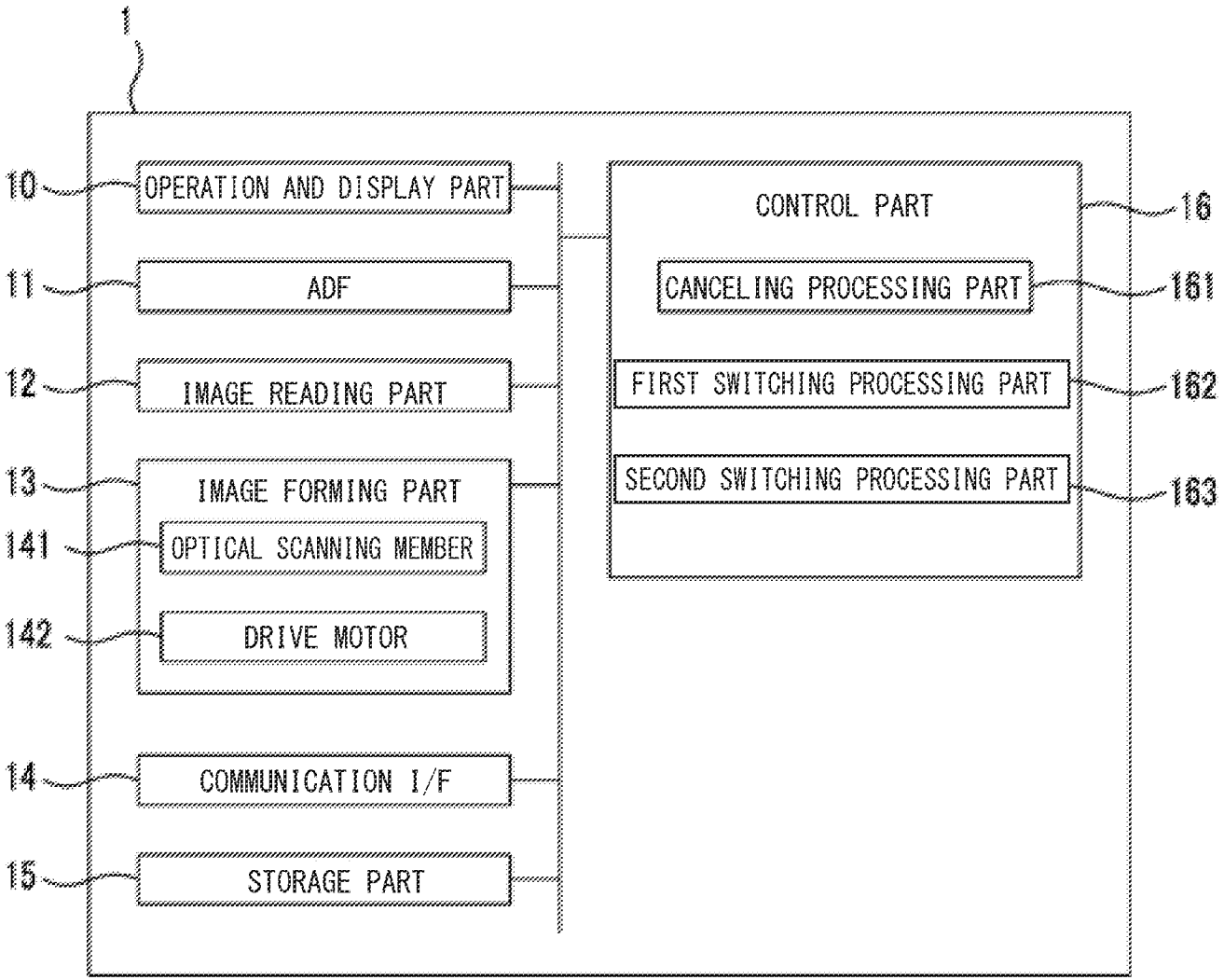
FIG. 1 is a block diagram showing a configuration of an image forming apparatus according to one embodiment of the present disclosure.

As shown in FIG. 1, an image forming apparatus 1 according to the embodiment of the present disclosure includes an operation and display part 10, an auto document feeder (ADF) 11, an image reading part 12, an image forming part 13, a communication I/F 14, a storage part 15 and a control part 16. Specifically, the image forming apparatus 1 is a multifunctional peripheral having a printing function, a scanning function, a copying function and a facsimile function. The present disclosure is not limited to the multifunctional peripheral, and applicable for any image forming apparatus such as a scanner, a copying machine, a printer and a facsimile.

The operation and display part 10 includes a display part on which information is displayed, such as a liquid crystal panel, and an operation part to which a user operation is input, such as a touch panel. The operation and display part 10 may include a hard key to which a user operation is input.

The ADF 11 is an automatic document conveyance device which includes a document placement part, a conveyance roller, a document pressing member and a document discharge part and conveys a document which is an object to be read by the image reading part 12. The image reading part 12 includes a document tray, a light source, a mirror, an optical lens and a charge coupled device (CCD), can read an image of the document and then output it as an image data.

Figure 2:
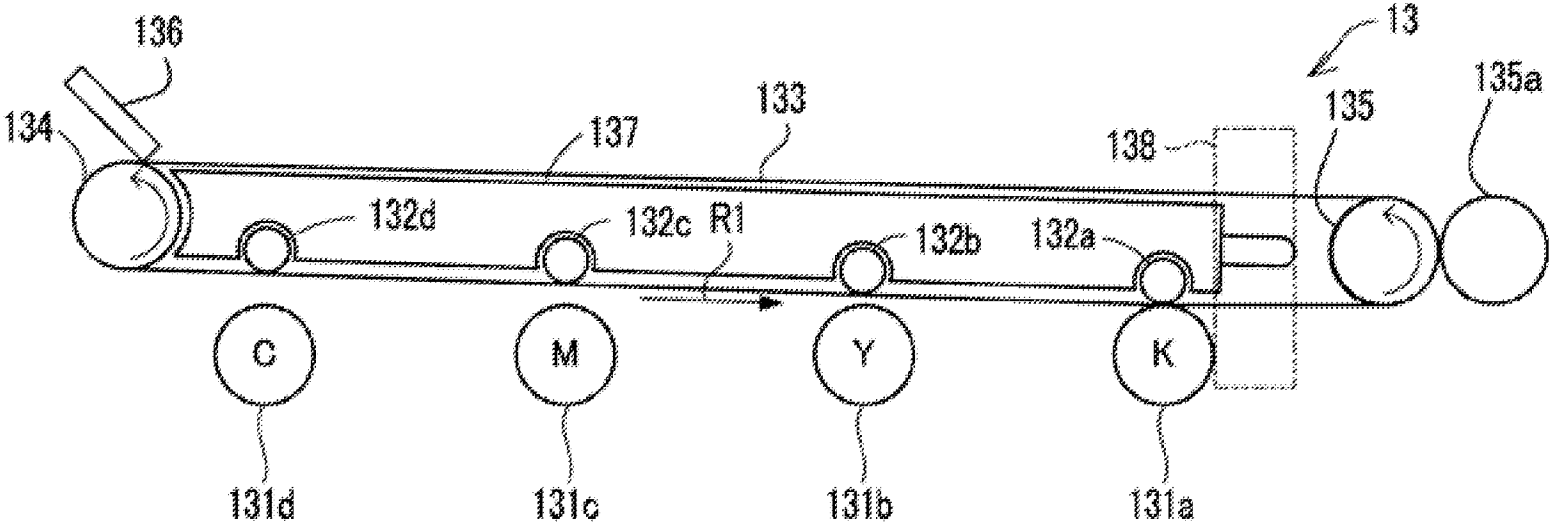
FIG. 2 is a view schematically showing an intermediate transferring belt and a photosensitive drum in a state where a supporting member is in a first state, in the embodiment of the present disclosure.
Figure 3:
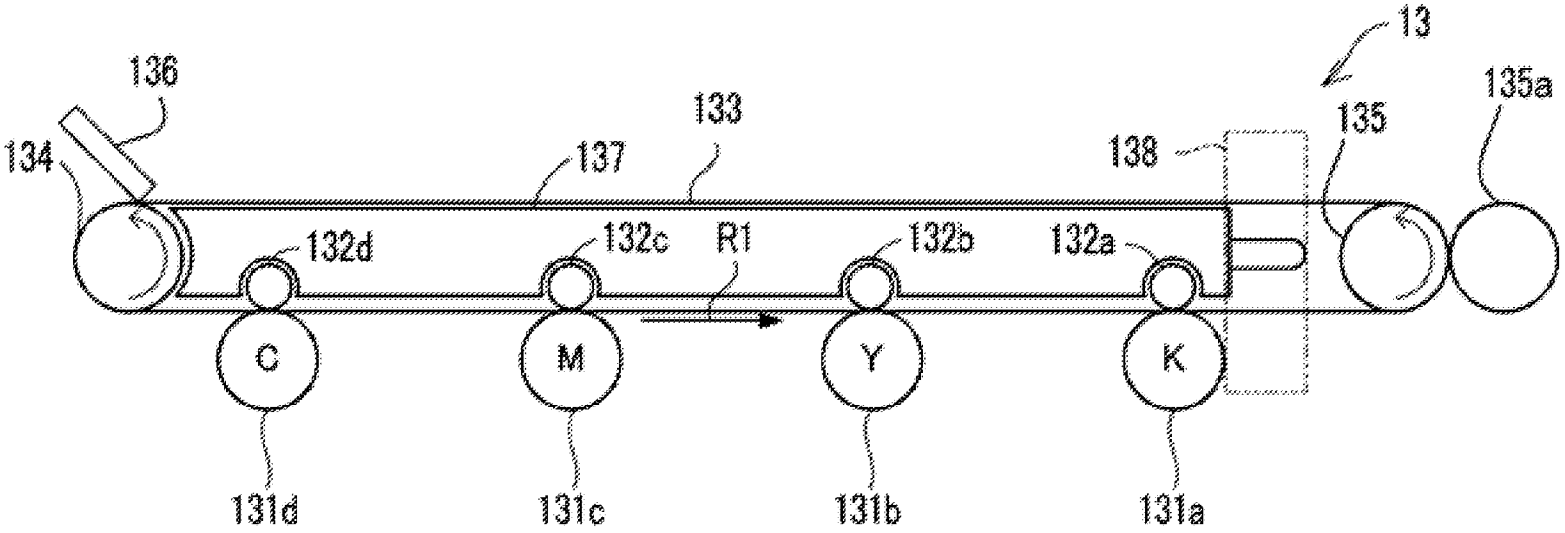
FIG. 3 is a view schematically showing the intermediate transferring belt and the photosensitive drum in a state where the supporting member is in a second state, in the embodiment of the present disclosure.

The image forming part 13 is an electrophotographic type image forming part which forms a monochrome image or a color image on a sheet, such as a paper sheet, fed from a sheet feeding cassette (not shown), based on the image data. Specifically, as shown in FIG. 2, the image forming part 13 includes a plurality of photosensitive drums 131*a* to 131*d*, a plurality of primary transferring rollers 132*a* to 132*d*, an intermediate transferring belt 133, a drive roller 134, a secondary transferring roller 135, a cleaning member 136, a supporting member 137, a drive mechanism 138 and the others.

The image forming apparatus 1 has a plurality of printing modes which are different in printing conditions in the image forming part 13, and the image forming apparatus 1 performs an image forming by the image forming part 13 in any one of the printing modes. Specifically, the plurality of printing modes contains a monochrome printing mode printing a monochrome image and a color printing mode printing a color image.

The photosensitive drums 131*a*, 131*b*, 131*c* and 131*d* are image carriers on which toner images of colors of black (K), yellow (Y), magenta (M) and cyan (C) are formed, respectively, and are driven by motors (not shown) to be rotated. On each of the photosensitive drums 131*a* to 131*d*, an electrostatic latent image corresponding to the toner image of each color is formed by laser light emitted from an optical scanning device (not shown). Then, the electrostatic latent image formed on each of the photosensitive drums 131*a* to 131*d* is developed into a toner image of the corresponding color by a development device (not shown). The toner images on the photosensitive drums 131*a* to 131*d* are transferred on the intermediate transferring belt 133.

The optical scanning device includes an optical scanning member 141, such as a polygon mirror, which is driven to be rotated to scan the light emitted from a light source, such as a laser diode, in a predetermined direction, and a drive motor 142 which rotates the optical scanning member 141. A rotational speed of the drive motor 142 is an example of the above described printing condition, and is previously set according to the printing mode in the image forming apparatus 1.

Specifically, the rotational speed is different between the monochrome printing mode and the color printing mode, and the rotational speed in the monochrome printing mode is set to be faster than the rotational printing speed in the color printing mode. In the image forming apparatus 1, because the image forming processing in the image forming part 13 is started after the rotational speed of the drive motor 142 is stabilized, when the rotational speed of the drive motor 142 is changed, a certain period of time is required until the rotational speed is stabilized after the changing.

The primary transferring rollers 132*a* to 132*d* are respectively provided corresponding to the photosensitive drums 131*a* to 131*d*, and are primary transferring members each used to transfer each of the color toner images from each of the photosensitive drums 131*a* to 131*d* to the intermediate transferring belt 133. Each of the primary transferring rollers 132*a* to 132*d* is provided with coming into contact with the intermediate transferring belt 133, and is driven by a motor (not shown) to be rotated.

The intermediate transferring belt 133 is an endless belt disposed between a drive roller 134 and a secondary transferring roller 135 with tension. The intermediate transferring belt 133 is an intermediate transferring member to which the toner image of each color formed on each of the photosensitive drums 131*a* to 131*d* is transferred, and the monochrome toner image or the color toner image formed on the intermediate transferring belt 133 is transferred to the sheet. The image forming part 13 may be a so-called 4-cycle type image forming part in which the toner images are formed on a single photosensitive drum successively and then successively transferred from the photosensitive drum to the intermediate transferring member.

One of or both the drive roller 134 and the secondary transferring roller 135 are driven by a drive force from a motor (not shown) to circulate the intermediate transferring belt 133 in a direction R1. The secondary transferring roller 135 rotates while pressing the sheet against an opposite roller 135*a* disposed opposite to the secondary transferring roller 135 across the intermediate transferring belt 133, and transfers the monochrome toner image or the color toner image formed on the intermediate transferring belt 133 to the sheet. The toner image transferred to the sheet is melted and fixed on the sheet by a fixing device (not shown). The opposite roller 135*a* is supported by a contact and separate mechanism (not shown) so as to come into contact with and separate from the intermediate transferring belt 133. When an image canceling operation described later is performed, the opposite roller 135*a* separates from the intermediate transferring belt 133.

The cleaning member 136 is used to remove the toner on the intermediate transferring belt 133. For example, the cleaning member 136 is a cleaning blade or a cleaning brush disposed with coming into contact with the surface of the intermediate transferring belt 133. The cleaning member 136 is used to remove the toner remaining on the intermediate transferring belt 133 after the toner image is transferred from the intermediate transferring belt 133 to the sheet, and is also used to cancel the toner image formed on the intermediate transferring belt 133 in the image canceling operation described later.

The supporting member 137 is a frame member which supports the primary transferring rollers 132*a* to 132*d*. The drive mechanism 138 drives the supporting member 137 by a drive force from a motor (not shown), and makes it possible to bring and separate the photosensitive drums 131*b* and 131*d*, which are not used in the monochrome printing mode, of the plurality of photosensitive drums 131*a* to 131*d* into contact with and from the intermediate transferring belt 133. The supporting member 137 and the contact and separate operation by the drive mechanism 138 are well known, and their detailed descriptions are omitted here. The contact and separate state between the intermediate transferring belt 133 and the photosensitive drums 131*b* to 131*d* is an example of the above described printing condition, and is previously set according to the printing mode in the image forming apparatus 1. Specifically, the drive mechanism 138 displaces the supporting member 137 between a first state corresponding to the monochrome printing mode and a second state corresponding to the color printing mode.

In the first state, the intermediate transferring belt 133 is brought into contact with the photosensitive drum 131*a* corresponding to the black color while the photosensitive drums 131*b* to 131*d* corresponding to the other colors are separated from the intermediate transferring belt 133. Then, in the monochrome printing mode, only the black toner image is transferred from the photosensitive drum 131*a* to the intermediate transferring belt 133 by the primary transferring roller 132*a*. Additionally, in the first state, for the primary transferring rollers 132*a* to 132*d*, only the primary transferring roller 132*a* corresponding to the black color is brought into contact with the photosensitive drum 131*a* across the intermediate transferring belt 133 while the primary transferring rollers 132*b* to 132*d* corresponding to the other colors are separated from the photosensitive drums 131*b* to 131*d* together with the intermediate transferring belt 133. In the first state, the primary transferring rollers 132*b* to 132*d* may be separated from the intermediate transferring belt 133. Additionally, in the first state, in the image forming processing performed by the image forming part 13, the driving of the photosensitive drums 131*b* to 131*d* and the primary transferring rollers 132*b* to 132*d* may be stopped.

In the second state, the intermediate transferring belt 133 is brought into contact with the photosensitive drums 131*a* to 131*d* corresponding to all colors. Then, in the color printing mode, the toner image of each color is overlapped and transferred on the intermediate transferring belt 133 from each of the photosensitive drums 131*a* to 131*d* by each of the primary transferring rollers 132*a* to 132*d*, and then the color image is formed on the intermediate transferring belt 133. In the second state, the primary transferring rollers 132*a* to 132*d* corresponding to all colors are brought into contact with the photosensitive drums 131*a* to 131*d* across the intermediate transferring belt 133.

The communication I/F 14 is a communication interface capable of performing a communication processing to and from an information processing device, such as an external facsimile and an external personal computer, according to a predetermined communication protocol through a communication network, such as a telephone line, an internet and a LAN.

The storage part 15 is a nonvolatile storage part such as a hard disk and a EEPROM (trademark). Specifically, the storage part 15 stores image forming program which causes a computer, such as the control part 16, to execute the image forming described later. The storage part 15 stores the image data to be printed by the image forming apparatus 1.

The control part 16 includes a control device such as a CPU, a ROM and a RAM. The CPU is a processer executing various arithmetic processing. The ROM is a nonvolatile storage part in which information, such as control program for causing the CPU to execute various processing, is previously stored. The RAM is a volatile or nonvolatile storage part used as a temporally storage memory (a working area) of various processing executed by the CPU.

For example, the control part 16 is executable a printing processing which causes the image forming part 13 to perform the image forming processing for forming an image on the sheet based on an image data input from an external device or an image data stored in the storage part 15. The control part 16 is executable a copying processing which causes the image forming part 13 to perform the image forming processing for reading an image of the document placed on the image reading part 12 and then forming an image on the sheet based on the read image data.

By the way, in the image forming apparatus 1 having the plurality of printing modes, because a certain period of time is required for a mode switching processing for switching the printing mode, if the printing mode is frequently switched, there is a problem that a productivity of the image forming apparatus 1 is deteriorated. Whereas, in the image forming apparatus 1 according to the embodiment, it becomes possible to switch the printing mode according to the content of the document while suppressing the deteriorating of the productivity.

Specifically, the control part 16 includes a canceling processing part 161, a first switching processing part 162, a second switching processing part 163 and the others. The control part 16 functions as processing parts by executing various processing according to the image processing program. The control part 16 may include one or more electronics circuits achieving a part or all of the processing functions of these processing parts.

The canceling processing part 161 enables to perform the image canceling operation in which the toner image formed on the intermediate transferring belt 133 is removed from the intermediate transferring belt 133 without transferred to the sheet, as needed. In the image canceling operation, under a state where the opposite roller 135*a* is separated from the secondary transferring roller 135, the intermediate transferring belt 133 is circulated until a toner image formed area on the intermediate transferring belt 133 passes through the cleaning member 136 for one time or several times or until a predetermined period is elapsed, thereby to cancel the toner image on the intermediate transferring belt 133.

For example, in a case where a delay occurs in a sheet conveyance in the image forming apparatus 1, the canceling processing part 161 performs the image canceling operation. Specifically, in the image forming processing performed in the image forming part 13 of the image forming apparatus 1, a processing until the toner images are transferred from the photosensitive drums 131*a* to 131*d* to the intermediate transferring belt 133 is performed in parallel with a processing to convey the sheet from a sheet feeding part (not shown) to the image forming part 13. The sheet fed from the sheet feeding cassette (not shown) and reached the image forming part 13 before a predetermined timing is conveyed to the image forming part 13 at a predetermined image forming start timing, and then an image is formed on the sheet in the image forming part 13. Then, if a delay occurs in the sheet conveyance owing to conveyance failure such as slipping during the conveyance of the sheet and the sheet conveyance is late for the predetermined timing, the image canceling operation is performed in order to remove the toner image formed on the intermediate transferring belt 133. In this case, the image forming processing is started again after the image canceling operation is completed.

The first switching processing part 162 enables to switch the printing mode of the image forming part 13 between the plurality of printing modes different from each other in the printing condition in the image forming part 13, based on the image data under waiting for printing and a predetermined set first switching condition. The image data under waiting for printing may contain an image data to be printed at the earliest and an image data to be printed after the image data to be printed at the earliest. Hereinafter, the image data to be printed at the earliest of the image data under waiting for printing may be called "the earliest image data". The switching of the printing mode is performed before the image forming processing based on the earliest image data is started.

In the first switching condition according to the present embodiment, in a case where the image data corresponding to the monochrome printing mode in the image data under waiting for printing continue for a predetermined number of times or more from the earliest image data, it is determined that the printing mode is switched to the color printing mode. The predetermined number of times is at least two or more. Thus, as compared with a case where the printing mode is switched for every time according to the type of color of the earliest image data, a number of switching times of the printing mode is suppressed so that the productivity of the image forming apparatus 1 is increased. In the first switching condition, in a case where the type of color of the earliest image data is the color type, it is determined that the printing mode is switched to the color printing mode.

In another embodiment, in the first switching condition, it may be determined that the printing mode is switched based on appearance frequency or appearance rate of the image data corresponding to the monochrome printing mode or the image data corresponding to the color printing mode in the image data under waiting for printing. The first switching condition is not limited to the above condition, but may be previously set based on various known technique.

The second switching processing part 163 enables to switch the printing mode based on the image data under waiting for printing and a predetermined second switching condition in a case where the canceling processing part 161 performs the image canceling operation. In the second switching condition, requirement for determining whether the printing mode is switched is more relaxed than the first switching condition.

Specifically, in the second switching condition, in a case where the printing mode corresponding to the earliest image data is different from the current printing mode, it is set that the current printing mode is switched to the printing mode corresponding to the earliest printing mode. As another embodiment, in the second switching condition, in a case where the image data corresponding to the monochrome printing mode continue for a number of times less than the predetermined number of times in the first switching condition, it may be set that the printing mode is switched to the monochrome printing mode.

Figure 4:
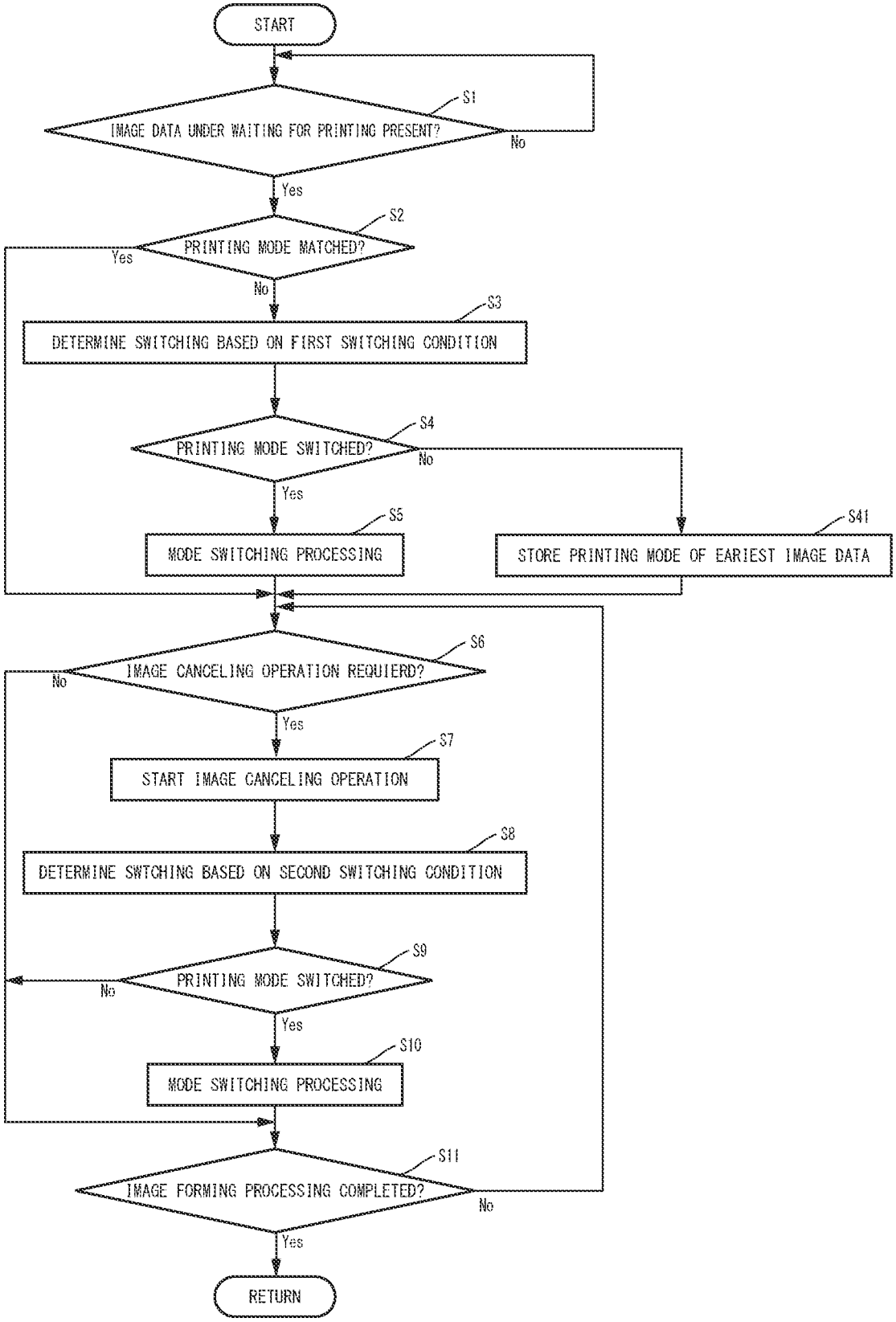
FIG. 4 is a flowchart showing an example of a mode control processing performed in the image forming apparatus according to the embodiment of the present disclosure.

Hereinafter, with reference to FIG. 4, an example of a procedure of a mode control processing executed by the control part 16 will be described. Here, step S1, step S2 and the others represent a number of processing procedures (steps) executed by the control part 16. Each processing procedures in the mode control processing may be executed in different order within a range in which a similar function and effect is obtained.

The present disclosure may be taken as a disclosure of an image forming method in which a part or all of the mode control processing are executed by the control part 16 or as a disclosure of an image processing program which causes the control part 16 to execute the mode control processing. In the image forming apparatus 1, the image forming processing to form an image on the sheet based on the image data is performed by the control part 16 in parallel with the mode control processing. Hereinafter, the image forming processing may be described as required, but a detailed description of the image forming processing is omitted.

<Step 1> In step 1, the control part 16 determines a presence or an absence of the image data under waiting for printing. For example, when the image data is stored in the storage part 15 as an object to be printed, the control part 16 determines that the image data under waiting for printing is present. Specifically, in a case where the image data corresponding to one or a plurality of pages is input as an object to be printed from an external information processing device to the image forming apparatus 1 and then stored in the storage part 15, the control part 16 determines that the image data under waiting for printing is present. Alternatively, the control part 16 determines that the image data under waiting for printing is present even in a case where a starting operation of the copying processing is performed for the operation and display part 10, the image data is read and then stored in the storage part 15. Then, when it is determined the image data under waiting for printing is present (S1: Yes), the processing proceeds to step S2 while when it is determined that the image data under waiting for printing is absent (S1: No), the processing waits in step S1.

<Step S2> In step S2, the control part 16 determines whether the printing mode corresponding to the earliest image data matches with the current printing mode of the image forming apparatus 1. When it is determined that the printing modes are matched with each other (S2: Yes), the image forming processing based on the earliest image data is started, and the processing proceeds to step S6. On the other hand, when it is determined that the printing modes are not matched with each other (S2: No), the processing proceeds to step S3.

Specifically, in a case where any of the printing modes is previously set for the earliest image data, the control part 16 determines whether the set printing mode matches with the current printing mode of the image forming apparatus 1. Alternatively, the control part 16 may automatically determine the printing mode corresponding to the earliest printing mode based on whether the earliest image data contains a predetermined number of color pixels or more and then determine whether the determined printing mode matches with the current printing mode of the image forming apparatus 1. The way to specify the printing mode corresponding to the earliest image data is not limited to the above way, and various known technique may be applied.

<Step S3> In step S3, the control part 16 determines whether the printing mode of the image forming part 13 in the image forming apparatus 1 is switched, based on the image data under waiting for printing and the first switching condition. Specifically, in a case where the current printing mode is the monochrome printing mode, when the type of the earliest image data of the image data under waiting for printing is the color type, the control part 16 determines that the printing mode is switched from the monochrome printing mode to the color printing mode. In a case where the current printing mode is the color printing mode, when the monochrome type image data of the image data under waiting for printing continue for a predetermined number of times or more from the earliest image data, the control part 16 determines that the printing mode is switched from the color printing mode to the monochrome printing mode.

<Step S4> In step S4, when it is determined in step S3 that the printing mode is switched (S4: Yes), the control part 16 transfers the processing to step S5 while when it is determined in step S3 that the printing mode is not switched (S4: No), the control part 16 transfers the processing to step S41.

<Step S41> In step S41, the control part 16 stores the printing mode corresponding to the earliest image data in the storage part 15 to which the control part 16 can be referred or the RAM of the control part 16. When it is determined that the image forming processing based on the earliest image data is completed (S11: Yes), the control part 16 deletes the information of the printing mode corresponding to the earliest image data stored in the storage part 15 or the RAM of the control part 16. In this case, the control part 16 starts the image forming processing based on the earliest image data without switching the printing mode.

As another embodiment, in places of the information of the printing mode corresponding to the earliest image data, a switching flag showing that the switching of the printing mode is originally required may be stored, and in step 8 described later, it may be determined whether the printing mode is switched, based on the switching flag.

<Step S5> In step S5, the control part 16 executes the mode switching processing to switch the printing mode. The above steps S3 to S5 are executed by the first switching processing part 162 of the control part 16, and are an example of a first switching step according to the present disclosure. When the mode switching processing is completed in step S5, the control part 16 starts the image forming processing based on the earliest image data.

Specifically, in a case where the current printing mode is the color printing mode, the control part 16 controls the drive mechanism 138 to shift the supporting member 137 from the second state to the first state. That is, the control part 16 separates the intermediate transferring belt 133 from the photosensitive drums 131*b* to 131*d*. As a result, in the image forming part 13, the photosensitive drum 131*a* only comes into contact with the intermediate transferring belt 133, and the image forming processing of the monochrome image can be performed. Additionally, the control part 16 changes the rotational speed of the drive motor 142 from the rotational speed for the color printing mode to the rotational speed for the monochrome printing mode.

On the other hand, in a case where the current printing mode is the monochrome printing mode, the control part 16 controls the drive mechanism 138 to shift the supporting member 137 from the first state to the second state. That is, the control part 16 brings the intermediate transferring belt 133 into contact with the photosensitive drums 131*b* to 131*d*. As a result, in the image forming part 13, the photosensitive drums 131*a* to 131*d* come into contact with the intermediate transferring belt 133, and the image forming processing of the color image can be performed. Additionally, the control part 16 changes the rotational speed of the drive motor 142 from the rotational speed for the monochrome printing mode to the rotational speed for the color printing mode.

<Step S6> In step S6, the control part 16 determines whether the image canceling operation is required in the image forming processing based on the earliest image data. When it is determined that the image canceling operation is required (S6: Yes), the processing proceeds to step S7 while when it is determined that the image canceling operation is not required (S6: No), the processing proceeds to step S11.

For example, in a case where a delay occurs in the sheet conveyance to the image forming part 13 during the conveyance of the sheet and the sheet conveyance is late for the predetermined timing, the control part 16 determines that the image canceling processing is required. In a case where the sheet conveyance to the image forming part 13 is late for the predetermined timing due to a switching operation of the sheet feeding cassette from which the sheet is fed, the control part 16 also determines that the image canceling operation is required. The determination whether the image canceling operation is required is not limited to the above way, and whether the image canceling operation is required may be determined based on another determination criterion.

When it is determined that the image canceling operation is required (S6: Yes), the control part 16 stops the image forming processing based on the earliest image data, and performs the image forming processing based on the earliest image data again after the image canceling operation is completed. In a case where the mode switching processing is executed in step S10 described later, if a period required for the mode switching processing is longer than a period required for the image canceling operation, the image forming processing based on the earliest image data is performed again after the mode switching processing is performed.

<Step S7> In step S7, the control part 16 starts the image canceling operation, and transfers the processing to step S8. In the image canceling operation, the toner image on the intermediate transferring belt 133 is removed by the cleaning member 136 without transferred to the sheet, as described above. Step S7 is executed by the canceling processing part 161 of the control part 16, and is an example of a canceling step according to the present disclosure.

<Step S8> In step S8, the control part 16 determines whether the printing mode is switched, based on the image data under waiting for printing and the second switching condition. In the embodiment, in step S2, it is previously determined whether the printing modes are matched with each other, based on the image data under waiting for printing. In a case where the printing mode is not switched even though the switching of the printing mode is originally required, in step S41, the printing mode corresponding to the earliest image data is stored in the storage part 15 or the RAM of the control part 16. Then, in a case where the printing mode corresponding to the earliest image data is stored in the storage part 15 or the RAM of the control part 16, the control part 16 determines that the printing mode is switched. On the other hand, in a case where the printing mode corresponding to the earliest image data is not stored in the storage part 15 or the RAM of the control part 16, the control part 16 determines that the printing mode is not switched. As another embodiment, in step S8, it may be determined whether the printing mode corresponding to the earliest image data of the image data under waiting for printing matches with the current printing mode of the image forming apparatus 1.

<Step S9> In step S9, when it is determined that the printing mode is switched in step S8 (S9: Yes), the control part 16 transfers the processing to step S10 while when it is determined that the printing mode is not switched in step S8 (S9: No), the control part 16 transfers the processing to step S11.

<Step S10> In step S10, the control part 16 executes the mode switching processing in the same manner as step S5 described above. The steps S8 to S10 are executed by the second switching processing part 163 of the control part 16, and are an example of a second switching step according to the present disclosure. The control part 16 restarts the image forming processing based on the earliest image data after the mode switching processing in above step S10 is completed.

Specifically, in a case where the current printing mode is the color printing mode, the control part 16 switches the printing mode to the monochrome printing mode while in a case where the current printing mode is the monochrome printing mode, the control part 16 switches the printing mode to the color printing mode.

<Step S11> In step S11, the control part 16 determines whether the image forming processing for the earliest image data is completed. When it is determined that the image forming processing is completed (S11: Yes), the processing returns to step S1. When there is an image data to be printed next, the image data is set to be the earliest image data, and the processing after step S2 are executed. When it is not determined that the image forming processing is completed (S11: No), the processing returns to step S6.

As a way to determine whether the image forming processing for the earliest image data is completed, various known technique may be applied. For example, when the sheet conveyed corresponding to the earliest image data passes through the image forming part 13, it may be considered that it is determined that the image forming processing is completed. Alternatively, when the sheet conveyed corresponding to the earliest image data passes the image forming part 13 and then discharged to a discharge part (not shown), it may be determined that the image forming processing is completed.

As described above, in the image forming apparatus 1 according to the present embodiment, when the image canceling operation is performed, the mode switching processing can be executed by using the period required for the image canceling operation while assuming that the printing mode is basically switched based on the first switching condition. Accordingly, in the image forming apparatus 1, it becomes possible to switch the printing mode based on the image data while suppressing the deteriorating of the productivity due to the switching of the printing mode.

[Another embodiment] In the above embodiment, a case where the printing mode contains two types of printing modes of the monochrome printing mode and the color printing mode is described as an example. However, the image forming apparatus 1 may contain three or more types of printing mode. For example, the image forming apparatus 1 may contain four types of printing modes of a high speed monochrome printing mode, a normal monochrome printing mode, a high speed color printing mode and a normal color printing mode. Both the high speed monochrome printing mode and the normal monochrome printing mode are the monochrome printing mode, but they are different from each other in resolution of the image formed based on the image data. In the same manner, both the high speed color printing mode and the normal color printing mode are the color printing mode, but they are different from each other in resolution of the image formed based on the image data. The resolution is previously set in the printing setting of the image data. The first switching conditions are previously set so as correspond to the high speed monochrome printing mode, the normal monochrome printing mode, the high speed color printing mode and the normal color printing mode.

For example, in the high speed monochrome printing mode, the normal monochrome printing mode, the high speed color printing mode and the normal color printing mode, the printing conditions such as the contact and separate state between the photosensitive drums 131*b* to 131*d* and the intermediate transferring belt 133 or the rotational speed of the drive motor 142 of the optical scanning device are different from each other. Specifically, in the high speed monochrome printing mode and the normal monochrome printing mode, the supporting member 137 is in the first state corresponding to the monochrome printing mode, and in the high speed color printing mode and the normal color printing mode, the supporting member 137 is in the second state corresponding to the color printing mode. When the rotational speeds of the high speed monochrome printing mode, the normal printing mode, the high speed color printing mode and the normal color printing mode are set to K1, K2, K3 and K4 respectively, it is assumed that the rotational speeds satisfy the following relationship:

$$K1>K2, K2=K3, \text{ and } K3>K4.$$

In this case, in step S10, the second switching processing part 163 of the control part 16 may determine whether the printing mode is switched, based on the type of the printing mode before and after the switching. Especially, the second switching processing part 163 may switch the printing mode when the period required for the switching of the printing mode is shorter than the period required for the image canceling operation. It is assumed that the period required for the image canceling operation is previously set, and is set to T0.

Specifically, in a case where the printing mode is switched between the high speed monochrome printing mode and the normal monochrome printing mode, or a case where the printing mode is switched between the high speed color printing mode and the normal color printing mode, the rotational speeds (K1 and K2, or K3 and K4) are different from each other. Then, when the printing mode is switched, a processing for changing the rotational speed is required while it is not required to shift the supporting member 137. The period required for the switching the printing mode at this time is previously set, and is set to T1. Here, it is assumed that the period T1 is longer than the period T0 required for the image canceling operation.

In a case where the printing mode is switched between the normal monochrome printing mode and the high speed color printing mode, the rotational speeds (K2 and K3) of the drive motor 142 are the same while the state of the supporting member 137 is different from each other. Then, when the printing mode is switched, a processing to shift the supporting member 137 is required while the processing to change the rotational speed is not required. The period required for switching the printing mode at this time is previously set, and is set to T2. Here, it is assumed that the period T2 is equal to or shorter than the period T0 required for the image canceling operation. That is, it is assumed the period required for the contact and separate operation between the intermediate transferring belt 133 and the photosensitive drums 131*b* to 131*d* is shorter than the period for changing the rotational speed of the drive motor 142.

In a case where the printing mode is switched between the high speed monochrome printing mode and the high speed color printing mode, or in a case where the normal monochrome printing mode and the normal color printing mode, the rotational speeds (K1 and K3, K2 and K4) are different from each other, and the states of the supporting member 137 are also different from each other. Then, when the printing mode is switched, both the processing to change the rotational speed and the processing to shift the supporting member 137 are required. The period required for the switching the printing mode at the time is previously set, and is set to T3. Here, it is assumed that the period T3 is longer than the period T0 required for the image canceling operation. However, it is considerable that the period T3 is equal to the period T1.

In step S10, the second switching processing part 163 determines whether the printing mode is switched, based on the type of the printing mode before and after the switching processing. Specifically, in a case where it is determined that a combination of the types of the printing modes before and after the switching is a combination where the period T1, T2 or T3 is less than the period T0, the printing mode is switched. For example, in a case where the printing mode is switched between the normal monochrome printing mode and the high speed color printing mode, because the period T1 required for switching the printing mode is less than the period T0 required for image canceling operation, the printing mode is switched. On the other hand, when it is determined that the combination of types of the printing modes before and after the switching is not the combination where the period T1, T2 or T3 is less than the period T0, the printing mode is not changed.

As a result, the printing mode is switched only in a case where the printing mode can be switched within the period required for the image canceling operation, so that the deteriorating of the productivity of the image forming apparatus 1 is prevented.

The second switching processing part 163 may calculate the period T0 required for the image canceling operation based on the content of the earliest image data, and determine whether the period T1, T2 or T3 required for switching the printing mode is less than the period T0 required for the image canceling operation.

For example, as the printing rate of the earliest image data is high, the driving period of the intermediate transferring belt 133 required for removing the toner image on the intermediate transferring belt 133 becomes long. Then, the canceling processing part 161 may determine the driving period of the intermediate transferring belt 133 in the image canceling operation according to the printing rate of the earliest image data. Then, the second switching processing part 163 may calculate the period T0 required for the image canceling operation according to the printing rate of the earliest image data.

In a case where the current printing mode is the color printing mode, the driving period of the intermediate transferring belt 133 required for removing the toner image on the intermediate transferring belt 133 may be longer than a case where the current printing mode is the monochrome printing mode. Then, the canceling processing part 161 may determine the driving period of the intermediate transferring belt 133 in the image canceling operation according to whether the current printing mode is the monochrome printing mode or the color printing mode. Then, the second switching processing part 163 may calculate the period required for the image canceling operation according to the type of the current printing mode. The way to determine the period T0 required for the image canceling operation by the second switching processing part 163 is not limited to the above method.

The above embodiment describes that the intermediate transferring belt 133 is an example of an intermediate transferring member. On the other hand, for example, the image forming apparatus capable of printing a monochrome image only may have a high speed monochrome printing mode and the normal monochrome printing mode, and be switched between the high speed monochrome printing mode and the normal monochrome printing mode as needed. In the image forming apparatus of this type, the toner image is transferred from the photosensitive drum 131*a* to the sheet without through the intermediate transferring belt 133. In this case, the photosensitive drum 131*a* may be taken as the intermediate transferring member according to the present disclosure. That is, the canceling processing part 161 may perform the image canceling operation to remove the toner image formed on the photosensitive drum 131*a* from the photosensitive drum 131*a* without transferred to the sheet as needed. In this case, the first switching processing operation 162 may switch the printing mode in the image forming part 13 between a plurality of printing modes having different printing conditions in the image forming part 13 based on the image data under waiting for printing and the predetermined first switching condition. When the image canceling operation is performed, the second switching processing part 163 may switch the printing mode based on the image data under waiting for printing and the predetermined second switching condition. Then, in the image forming apparatus for monochrome image, the switching of the printing mode, such as the changing of the rotational speed of the drive motor 142, can be performed by using the period required for the image canceling operation.

It should be noted that the present disclosure can be suitably modified within a range that it is not inconsistent with the scope of the claims and the gist or idea of the disclosure which can be read from the entire specification, and the image forming apparatus and image forming method accompanying such modification are also included in the technical idea of the present disclosure.

The invention claimed is:

1. An image forming apparatus comprising:

an image forming part which transfers a toner image formed on an intermediate transferring member from the intermediate transferring member to a sheet;

a canceling processing part performing an image canceling operation where the toner image formed on the intermediate transferring member is removed from the intermediate transferring member without transferred to the sheet;

a first switching processing part capable of switching a printing mode in the image forming part between a plurality of printing modes having different printing conditions in the image forming part, based on an image data under waiting for printing and a predetermined first switching condition; and a second switching processing part capable of switching the printing mode based on the image data under waiting for printing and a predetermined second switching condition when the image canceling operation is performed.

2. The image forming apparatus according to claim 1, wherein the plurality of printing modes has a monochrome printing mode in which a monochrome image is printed and a color printing mode in which a color image is printed, the image forming part includes:

a plurality of image carriers from which the toner images are transferred to the intermediate transferring member, and a drive mechanism which brings and separates the image carrier, which is not used in the monochrome printing mode, of the plurality of image carriers into contact with and from the intermediate transferring member, and the printing conditions in the monochrome printing mode and the color printing mode are different from each other in a contact and separation state between the intermediate transferring member and the image carriers.

3. The image forming apparatus according to claim 2, wherein the image forming part includes:

an optical scanning member which scans each of image carriers with laser light for forming an electrostatic latent image on each of the image carriers, and a drive motor which rotates the optical scanning member, and the printing conditions in the monochrome printing mode and the color printing mode are different from each other in a rotational speed of the drive motor.

4. The image forming apparatus according to claim 1, wherein in a case where the printing mode corresponding to the earliest image data of the image data under waiting for printing is different from the current printing mode, it is determined in the second switching condition that the current printing mode is switched to the printing mode corresponding to the earliest image data.

5. The image forming apparatus according to claim 1, wherein the second switching processing part determines whether the printing mode is switched, based on a type of the printing mode before and after the switching.

6. The image forming apparatus according to claim 5, wherein the second switching processing part switches the printing mode in a case where a period required for the switching of the printing mode is equal to or less than a period required for the image canceling operation.

7. The image forming apparatus according to claim 1, wherein the canceling processing part performs the image canceling operation in a case where a delay occurs in conveyance of the sheet.

8. The image forming apparatus according to claim 1, wherein the printing mode is switched to the monochrome printing mode in the first switching condition in a case where the image data corresponding to the monochrome printing mode of the image data under waiting for printing continues for a predetermined number of times or more from the earliest image data of the image data under waiting for printing.

9. The image forming apparatus according to claim 1, wherein the printing mode is switched in the first switching condition, based on an appearance frequency or an appearance rate of the image data corresponding to the monochrome printing mode or the image data corresponding to the color printing mode of the image data under waiting for printing.

10. The image forming apparatus according to claim 8, wherein the printing mode is switched to the monochrome printing mode in the second switching condition in a case where the image data corresponding to the monochrome printing mode continues for less than the predetermined number of times in the first switching condition.

11. The image forming apparatus according to claim 1, wherein the first switching processing part and the second switching processing part switch the printing mode among four printing modes including a high speed monochrome printing mode, a normal monochrome printing mode, a high speed color printing mode and a normal color printing mode.

12. An image forming method in an image forming apparatus including an image forming part which transfers a toner image formed on an intermediate transferring member from the intermediate transferring member to a sheet, the image forming method comprising:

a canceling step performing an image canceling operation where the toner image formed on the intermediate transferring member is removed from the intermediate transferring member without transferred to the sheet;

a first switching step capable of switching a printing mode in the image forming part between a plurality of printing modes having different printing conditions in the image forming part, based on an image data under waiting for printing and a predetermined first switching condition; and a second switching step capable of switching the printing mode based on the image data under waiting for printing and a predetermined second switching condition when the image canceling operation is performed.

* * * * *